US008820911B2

(12) United States Patent
Nakao et al.

(10) Patent No.: US 8,820,911 B2
(45) Date of Patent: Sep. 2, 2014

(54) COATING APPARATUS AND IMAGE FORMING APPARATUS

(75) Inventors: Motoharu Nakao, Kanagawa (JP); Hiroshi Ikeda, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 452 days.

(21) Appl. No.: 13/110,417

(22) Filed: May 18, 2011

(65) Prior Publication Data

US 2012/0154497 A1 Jun. 21, 2012

(30) Foreign Application Priority Data

Dec. 15, 2010 (JP) ..... 2010-279348

(51) Int. Cl.
*B41J 2/01* (2006.01)
*B41J 2/005* (2006.01)

(52) U.S. Cl.
CPC ..... *B41J 2/0057* (2013.01)
USPC ..... 347/102; 347/101; 347/103

(58) Field of Classification Search
USPC ..... 347/95, 96, 101–103
See application file for complete search history.

(56) References Cited

U.S. PATENT DOCUMENTS

| | | | | |
|---|---|---|---|---|
| 6,064,411 | A * | 5/2000 | van Sas et al. | 347/115 |
| 6,447,101 | B1 * | 9/2002 | Adachi et al. | 347/55 |
| 2005/0061421 | A1 * | 3/2005 | Inoue | 156/230 |
| 2008/0239045 | A1 * | 10/2008 | Umebayashi et al. | 347/102 |
| 2009/0237479 | A1 * | 9/2009 | Yamashita et al. | 347/103 |
| 2010/0233615 | A1 * | 9/2010 | Takahashi et al. | 430/137.13 |
| 2012/0105541 | A1 * | 5/2012 | Inoue et al. | 347/31 |

FOREIGN PATENT DOCUMENTS

| | | |
|---|---|---|
| JP | A-2001-212956 | 8/2001 |
| JP | A-2005-119285 | 5/2005 |
| JP | A-2009-226805 | 10/2009 |

* cited by examiner

*Primary Examiner* — Sarah Al Hashimi
(74) *Attorney, Agent, or Firm* — Oliff PLC

(57) ABSTRACT

A coating apparatus includes a movable body, a particle feeding portion, a liquid feeding portion, a stimulus giving portion, and a nip portion. The movable body includes a circumferential face capable of rotating. The particle feeding portion feeds solid particles transparent to visible light to the circumferential face of the movable body. The liquid feeding portion feeds a hardenable liquid, in a form of a layer, on the circumferential face of the movable body supplied with the solid particles. The hardenable liquid is hardened by a stimulus given to the hardenable liquid. The stimulus giving portion gives the stimulus to the hardenable liquid fed on the circumferential face. The nip portion nips the hardenable liquid between the movable body and a recording medium.

10 Claims, 4 Drawing Sheets

COATING APPARATUS AND IMAGE FORMING APPARATUS

CROSS-REFERENCE TO RELATED APPLICATIONS

This application is based upon and claims priority under 35 USC 119 from Japanese Patent Application No. 2010-279348, filed Dec. 15, 2010.

BACKGROUND

Technical Field

The present invention relates to a coating apparatus and an image forming apparatus.

SUMMARY OF THE INVENTION

According to an aspect of the invention, a coating apparatus includes a movable body, a particle feeding portion, a liquid feeding portion, a stimulus giving portion, and a nip portion. The movable body includes a circumferential face capable of rotating. The particle feeding portion feeds solid particles transparent to visible light to the circumferential face of the movable body. The liquid feeding portion feeds a hardenable liquid, in a form of a layer, on the circumferential face of the movable body supplied with the solid particles. The hardenable liquid is hardened by a stimulus given to the hardenable liquid. The stimulus giving portion gives the stimulus to the hardenable liquid fed on the circumferential face. The nip portion nips the hardenable liquid between the movable body and a recording medium.

BRIEF DESCRIPTION OF THE DRAWINGS

Exemplary embodiments of the invention will be described in detail based on the following figures, wherein.

DETAILED DESCRIPTION

Exemplary embodiments of the invention will be described below with reference to the drawings.

Figure 1:
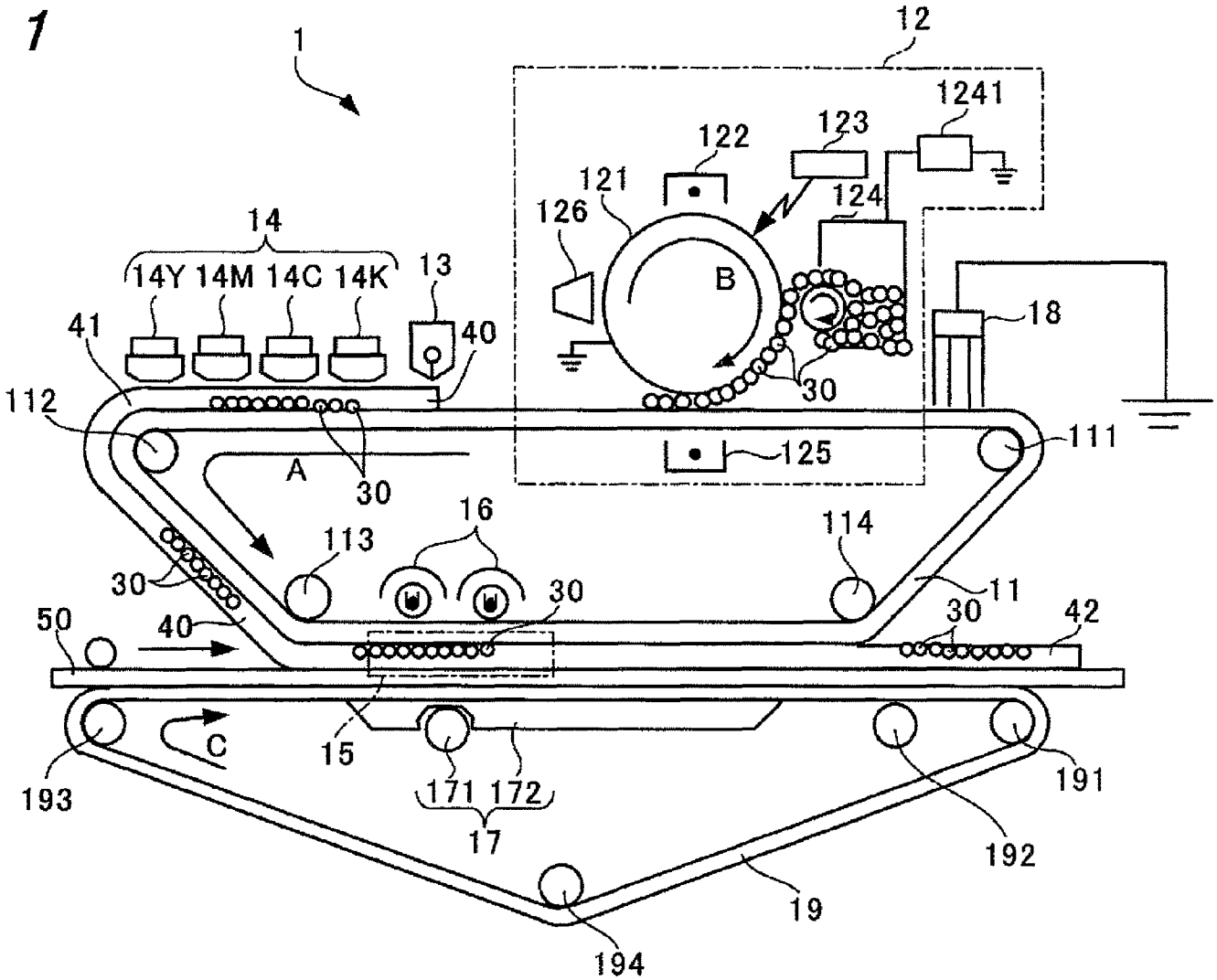
FIG. 1 is a schematic configuration diagram showing a first exemplary embodiment of an image forming apparatus according to the invention.

FIG. 1 is a schematic configuration diagram showing a first exemplary embodiment of an image forming apparatus according to the invention.

The image forming apparatus 1 shown in FIG. 1 is a so-called ink jet recording type image forming apparatus which discharges liquid ink or fused solid ink (hereinafter generically referred to as ink) from nozzles, slits, a porous film, etc. to thereby form an image with ink on a recording medium such as a sheet of paper, a piece of cloth or a film. As the ink discharging method, there may be used various methods such as a so-called charge control method for discharging ink by using electrostatic attraction force, a so-called drop-on-demand method (pressure pulse method) for discharging ink by using vibrational pressure of a piezoelectric element, and a so-called thermal ink jet method for discharging ink by using pressure generated by forming and growing bubbles with high heat.

The image forming apparatus 1 has an intermediate transfer belt 11 having a circumferential face rotating in a direction of arrow A, a particle feeding portion 12, a liquid feeding portion 13, an image forming portion 14, a nip portion 15, an ultraviolet irradiation portion 16, a coating portion 17, an intermediate transfer, belt static elimination device 18, and a recording medium conveyance belt 19 having a circumferential face rotating in a direction of arrow C. The particle feeding portion 12, the liquid feeding portion 13, the image forming portion 14, the nip portion 15, the coating portion 17 and the intermediate transfer belt static elimination device 18 are disposed around the intermediate transfer belt 11 in this order in view from an upstream side in the rotating direction of the intermediate transfer belt 11 (the direction of arrow A). The ultraviolet irradiation portion 16 is disposed inside the intermediate transfer belt 11 and in a position opposite to the nip portion 15 and the coating portion 17. The recording medium conveyance belt 19 is disposed outside the intermediate transfer belt 11 and in a position opposite to the nip portion 15.

The intermediate transfer belt 11 is an endless belt-shaped member supported by belt support rolls 111, 112, 113 and 114. The intermediate transfer belt 11 has a base portion, and a release layer formed on an outer face of the base portion. Incidentally, the intermediate transfer belt 11 may be provided as a single layer as long as the base portion per se is made of a material having release characteristic. Each of the base portion and the release layer may have a plurality of layers. The release layer is a layer of a material having so-called release characteristic. For this reason, adhesion of an outer face (front face) of the release layer is drastically lower than adhesion of the outer face of the base portion. Incidentally, the outer face of the release layer is the circumferential face of the intermediate transfer belt 11. The circumferential face is smooth. The intermediate transfer belt 11 corresponds to an example of a movable body described in the invention.

Since the ultraviolet irradiation portion 16 is provided inside the intermediate transfer belt 11 as described above, a liquid layer 41 is irradiated with ultraviolet rays which passed through the intermediate transfer belt 11. Although detailed description will be given later, the liquid layer 41 is a layer of a hardenable liquid 40 provided, in a form of a layer, on the circumferential face of the intermediate transfer belt 11. Accordingly, a material having high ultraviolet transmittance is used for the base portion of the intermediate transfer belt 11 in order to irradiate the liquid layer 41 with ultraviolet rays efficiently. Specifically, the ultraviolet transmittance of the base portion of the intermediate transfer belt 11 is not lower than 50% in a peak wavelength region of a hardening light source. When, for example, a UV-LED (with a peak wavelength of 385 nm) is used as the hardening light source, transmittance in 385 nm is measured. An ultraviolet and visible light spectrophotometer (model number: V-560) made by JASCO company is used for measurement of the transmittance. The base portion of the intermediate transfer belt 11 exhibits high durability to ultraviolet rays.

Since the ultraviolet transmittance of the base portion of the intermediate transfer belt 11 is equal to or higher than 50%, ultraviolet energy required for hardening reaction of the hardenable liquid 40 is efficiently supplied to the liquid layer 41 while deterioration of the intermediate transfer belt 11 caused by absorption of ultraviolet rays to the base portion of the intermediate transfer belt 11 is suppressed. Specific examples of the material for forming the base portion of the intermediate transfer belt 11 are ETFE (ethylene tetra fluoro ethylene), polyimide film, polyolefin-based film, etc.

Examples of the material used for the release layer of the intermediate transfer belt 11 include a fluorocarbon resin material, etc. Specific examples of the material include: powder coating compositions or resin tubes of fluorocarbon resin, fluorine-modified urethane and silicone resin, copolymeric fluorocarbon rubber, fluorocarbon resin-copolymeric vinyl ether, PFA (tetra fluoro ethylene-perfluoro alkylvinyl ether copolymer), FEP (fluorinated ethylene propylene), etc.; PTFE (poly tetra fluoro ethylene) coating composition; and PTFE-dispersed urethane coating composition; and further include ETFE (ethylene tetra fluoro ethylene) tube, PVdF (polyvinylidene fluoride), PHV (polytetrafluorovinylidene) resin materials, etc. Particularly, a material having high ultraviolet transmittance is preferred. On the other hand, when a material having low ultraviolet transmittance is used, it is preferable to reduce the film thickness of the release layer.

The particle feeding portion 12 feeds solid particles 30 transparent to visible light to the circumferential face of the intermediate transfer belt 11. The particle feeding portion 12 corresponds to an example of a particle feeding portion described in the invention. Specific examples of the solid particles 30 include particles of polyester, polystyrene, PMMA, silica, titanium dioxide, alumina, etc. It is preferable that the particle diameter of the solid particles 30 is in a range of about 10 μm to about 50 μm.

The liquid feeding portion 13 feeds a hardenable liquid 40, in a form of a layer, onto the circumferential face of the intermediate transfer belt 11 to thereby form a liquid layer 41. The hardenable liquid 40 is hardened when the hardenable liquid 40 is irradiated with ultraviolet rays. In addition, the liquid feeding portion 13 feeds the hardenable liquid 40 sratiformly on the circumferential face of the intermediate transfer belt 11 so that the hardenable liquid 40 overlaps the solid particles 30 on a downstream side of the particle feeding portion 12. The liquid feeding portion 13 corresponds to an example of a liquid feeding portion described in the invention. Ultraviolet rays correspond to an example of a specific stimulus described in the invention. Specifically, an apparatus, for example, using a feeding method (a coating method such as coating by a die coater or a bar coater, spray type coating, ink jet type coating, air knife type coating, blade type coating, roll type coating, etc.) is used as the liquid feeding portion 13. Here, in addition to an ultraviolet-hardenable material hardened by irradiation with ultraviolet rays, a material for fixing ink discharged from four ink jet recording heads 14Y, 14M, 14C and 14K in the image forming portion 14 which will be described later is also contained in the hardenable liquid 40. For example, the material for fixing ink is a liquid absorbing material exhibiting liquid absorption characteristic with respect to ink. Examples of the liquid absorbing material include a liquid absorbing resin, inorganic particles having face ink-hydrophilic characteristic, etc.

The image forming portion 14 discharges ink onto the liquid layer 41 formed by the liquid feeding portion 13 to thereby form an image with the ink on the liquid layer 41. More particularly, the four ink jet recording heads 14Y, 14M, 14C and 14K serving for formation of images of different colors respectively are disposed along the rotating direction (the direction of arrow A) of the intermediate transfer belt 11. The four ink jet recording heads 14Y, 14M, 14C and 14K form images with ink of respective colors, i.e. yellow (Y), magenta (M), cyan (C) and black (B), successively so that the images are superposed on one another. In this manner, a color image is formed. Specifically, for example, a line type ink jet recording head, a scan type ink jet recording head, etc. may be used as each of the ink jet recording heads 14Y, 14M, 14C and 14B. The line type ink jet recording head has a plurality of nozzles which are disposed so as to be aligned with a direction crossing the rotating direction (the direction of arrow A) of the intermediate transfer belt 11 so that the width of the ink jet recording head is equal to or larger than the width of the recording medium 50 on which an image is recorded. The scan type ink jet recording head has an ink jet recording head which is mounted in a cartridge scanning over a width equal to or larger than the width of the recording medium 50 in a direction crossing the rotating direction (the direction of arrow A) of the intermediate transfer belt 11.

The nip portion 15 nips the liquid layer 41 between the recording medium 50 and the intermediate transfer belt 11 by pressure of a pressure roll 171. The nip portion 15 corresponds to an example of a nip portion described in the invention.

The ultraviolet irradiation portion 16 forms a hardened layer 42 by irradiating the liquid layer 41 with ultraviolet rays transmitting through the intermediate transfer belt 11 in a state in which the liquid layer 41 is nipped between the recording medium 50 and the intermediate transfer belt 11 by the nip portion 15. The ultraviolet irradiation portion 16 corresponds to an example of a stimulus giving portion described in the invention. Specific examples of the ultraviolet irradiation portion 16 include a metal halide lamp, a high pressure mercury lamp, an ultra-high pressure mercury lamp, a deep ultraviolet lamp, a lamp using microwave for exciting a mercury lamp electrodelessly from the outside, an ultraviolet laser, a xenon lamp, a UV-LED, etc.

The coating portion 17 coats the face of the recording medium 50 with the hardened layer 42. Incidentally, as described above, the coating portion 17 is disposed in a position opposite to the ultraviolet irradiation portion 16. The hardened layer 42 with which the face of the recording medium 50 is coated by the coating portion 17 is a hardened layer 42 nipped between the recording medium 50 and the intermediate transfer belt 11 by the nip portion 15. To give description on the coating portion 17 more in detail, the coating portion 17 has a pressure roll 171, and a support body 172. The pressure roll 171 which presses the recording medium 50 from the back is disposed in a position opposite to the ultraviolet irradiation portion 16. The support body 172 supports the recording medium 50 from the back before and after pressing. In the condition that the recording medium 50 is pressed from the back by the pressure roll 171, the liquid layer 41 is irradiated with ultraviolet rays from the ultraviolet irradiation portion 16. When the liquid layer 41 is hardened to the hardened layer 42 in this manner, the hardened layer 42 adheres closely to the face of the recording medium 50. For this reason, an image formed by the image forming portion 14 is recorded on the recording medium 50 as a result of the liquid layer 41 nipped between the intermediate transfer belt 11 and the recording medium 50 by the nip portion 15. When the recording medium 50 then passes through the nip portion 15, the hardened layer 42 is strongly attracted toward the recording medium 50 to which the hardened layer 42 adheres closely. On the other hand, since the hardened layer 42 has low adhesion to the intermediate transfer belt 11 having the release layer, the hardened layer 42 is separated from the intermediate transfer belt 11 so that the face of the recording medium 50 is coated with the hardened layer 42. A combination of the image forming portion 14, the ultraviolet irradiation portion 16 and the nip portion 15 corresponds to an example of an image recording portion described in the invention.

The intermediate transfer belt static elimination device 18 eliminates electrostatic charges from the circumferential face of the intermediate transfer belt 11 to adjust electrically the circumferential face of the intermediate transfer belt 11 before electric field transfer performed by a transfer portion 125 which will be described later.

The recording medium conveyance belt 19 is an endless belt-shaped member which is supported by belt support rolls 191, 192, 193 and 194. The recording medium conveyance belt 19 conveys the recording medium 50 so that the recording medium 50 passes through the nip portion 15.

As shown in FIG. 1, the particle feeding portion 12 includes a photoconductor 121, a charging device 122, an exposure device 123, a developing device 124, the transfer portion 125, and a photoconductor static elimination device 126.

The photoconductor 121 of the particle feeding portion 12 has a face shaped like a cylinder. As the photoconductor 121 of the particle feeding portion 12 rotates in a direction of arrow B as a direction of moving around an axis of the cylinder, an image is formed and held on the face of the photoconductor 121. The photoconductor 121 corresponds to an example of an image holding portion described in the invention.

The charging device 122 of the particle feeding portion 12 charges the face of the photoconductor 121 with static electricity. The exposure device 123 of the particle feeding portion 12 irradiates the photoconductor 121 with exposure light based on an image signal supplied from the outside to thereby expose the face of the photoconductor 121 charged by the charging device 122 to the light to form an electrostatic image on the face of the photoconductor 121. The electrostatic image formed thus is an image which is formed on the face of the recording medium 50 and which represents an irregular pattern corresponding to a surface texture such as mat, gloss or emboss. When a region where such an image will be formed is controlled by the exposure device 123, etc., a region of the circumferential face of the intermediate transfer belt 11 to which solid particles 30 will be fed by the particle feeding portion 12 is controlled. That is, a region where the face property will be changed is controlled. A combination of the charging device 122 and the exposure device 123 corresponds to an example of an electrostatic image forming portion and an example of a region control portion described in the invention.

The developing device 124 of the particle feeding portion 12 contains solid particles 30 and charges the solid particles 30 with static electricity by stirring the solid particles 30 in its inside. The developing device 124 electrically deposits the solid particles 30 on an electrostatic image formed by the charging device 122 and the exposure device 123 to thereby form a particle image drawn with the solid particles 30. As described above, because the solid particles 30 are particles transparent to visible light, the particle image mentioned herein is an image which is hard to view. The developing device 124 does not perform so-called development but has the same configuration as that of a developing device in the electrophotographic technology which has been heretofore known in the background art. Therefore, the device for forming a particle image is referred to as "developing device" in the description here. The developing device 124 corresponds to an example of a particle image forming portion described in the invention. The developing device 124 has a developing bias voltage control portion 1241 for controlling a developing bias voltage of the developing device 124. The developing bias voltage control portion 1241 adjusts the supply concentration of solid particles 30 fed by the particle feeding portion 12. More particularly, when the developing bias voltage is made high, the supply concentration of the solid particles 30 fed by the particle feeding portion 12 increases. When the developing bias voltage is made low, the supply concentration of the solid particles 30 fed by the particle feeding portion 12 decreases. That is, to adjust the supply concentration is to adjust the intensity of irregularities corresponding to the surface texture of the recording medium 50. The developing bias voltage control portion 1241 corresponds to an example of a concentration adjusting portion described in the invention.

The transfer portion 125 of the particle feeding portion 12 charges the circumferential face of the intermediate transfer belt 11 with static electricity to thereby electric-field transfer a particle image from the face of the photoconductor 121 onto the circumferential face of the intermediate transfer belt 11. The transfer portion 125 corresponds to an example of a transfer portion described in the invention.

The photoconductor static elimination device 126 of the particle feeding portion 12 eliminates electrostatic charges from the face of the photoconductor 121 after transfer of the particle image. In this manner, the electrostatic image formed on the face of the photoconductor 121 is erased.

A combination of the intermediate transfer belt 11, the particle feeding portion 12, the liquid feeding portion 13, the ultraviolet irradiation portion 16 and the nip portion 15 in the aforementioned image forming apparatus 1 form an exemplary embodiment of a coating apparatus according to the invention.

Operation of the image forming apparatus 1 shown in FIG. 1 will be described below.

The photoconductor 121 is driven to rotate in the direction of arrow B so that electric charges are applied on the face of the photoconductor 121 by the charging device 122.

Next, the exposure device 123 irradiates the photoconductor 121 with exposure light based on an image signal supplied from the outside. In this manner, the face of the photoconductor 121 is exposed to light so that an electrostatic image is formed in a region of the face of the photoconductor 121 corresponding to a region of the circumferential face of the intermediate transfer belt 11 to which solid particles 30 will be fed. In this manner, the region of the circumferential face of the intermediate transfer belt 11 to which the solid particles 30 will be fed is determined.

Next, solid particles 30 transparent to visible light and charged with static electricity by the developing device 124 are electrically deposited on the electrostatic image formed on the face of the photoconductor 121. In this manner, a particle image drawn with the solid particles 30 is formed on the face of the photoconductor 121. On this occasion, as described above, the developing bias voltage of the developing device 124 is controlled by the developing bias voltage control portion 1241 to adjust the supply concentration of solid particles 30 to be fed, so that intensity of irregularities corresponding to the surface texture of the recording medium 50 is adjusted.

The particle image formed on the face of the photoconductor 121 is electric-field transferred onto the circumferential face of the intermediate transfer belt 11 by the transfer portion 125.

After transfer of the particle image, electrostatic charges are eliminated from the face of the photoconductor 121 by the photoconductor static elimination device 126 so that the electrostatic image formed on the face of the photoconductor 121 is erased.

Since the electrophotographic technology which has been heretofore known in the background art is used thus as the particle feeding portion 12, solid particles 30 are fed with high definition so that an irregular pattern of the aforementioned surface texture is drawn with high definition.

Figure 2:
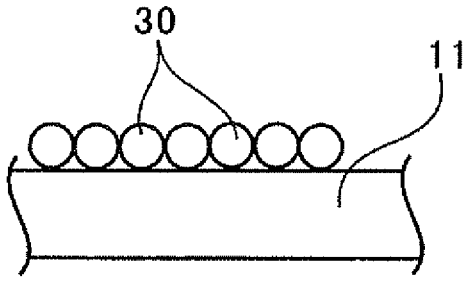
FIG. 2 is a schematic diagram showing solid particles as an image of particles transferred to a circumferential face of an intermediate transfer belt.

FIG. 2 is a schematic diagram showing solid particles 30 as an image of particles transferred onto the circumferential face of the intermediate transfer belt 11.

As shown in FIG. 2, solid particles 30 corresponding to the particle image transferred onto the circumferential face of the intermediate transfer belt 11 come into contact with the smooth circumferential face of the intermediate transfer belt 11. In this manner, the particle image is held on the circumferential face of the intermediate transfer belt 11. Although here is shown the case where the particle image is drawn as if the solid particles 30 were aligned, this is simply a schematic drawing. According to the supply concentration of the solid particles 30, the solid particles 30 may be disposed sparsely with a gap formed between adjacent ones of the solid particles 30, or other solid particles 30 may be placed on the line of the solid particles 30.

Referring back to FIG. 1, description about the operation of the image forming apparatus 1 will be continued.

The intermediate transfer belt 11 rotates in the direction of arrow A while receiving the transferred particle image in the condition that the intermediate transfer belt 11 is supported by the belt support rolls 111, 112, 113 and 114. In accordance with the rotation of the intermediate transfer belt 11, the particle image (solid particles 30) on the circumferential face of the intermediate transfer belt 11 is conveyed in the direction of arrow A.

By the liquid feeding portion 13, a hardenable liquid 40 is fed, in a form of a layer, onto the circumferential face of the intermediate transfer belt 11 by which the particle image is conveyed thus. In this manner, a liquid layer 41 is formed.

Figure 3:
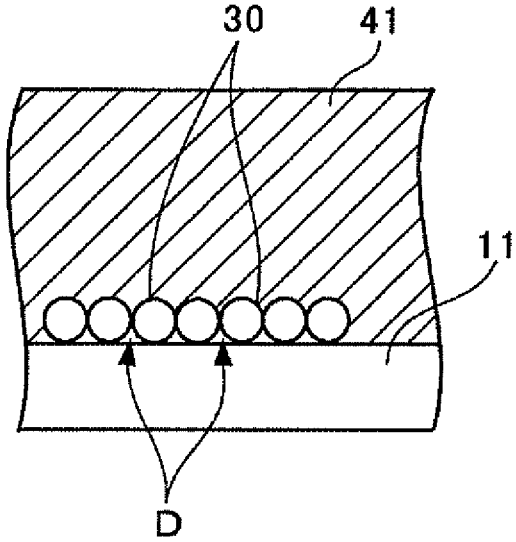
FIG. 3 is a schematic diagram showing a liquid layer.

FIG. 3 is a schematic diagram showing the liquid layer 41.

The hardenable liquid 40 is fed, in a form of a layer, onto the circumferential face of the intermediate transfer belt 11 so as to be superposed on the solid particles 30, so that the liquid layer 41 shown by hatching in FIG. 3 is formed. On this occasion, though the hardenable liquid 40 in the liquid layer 41 comes into gaps between the solid particles 30 to some degree so that the gaps are filled with the hardenable liquid 40, the hardenable liquid 40 does not come into gaps D between the solid particles 30 and the circumferential face of the intermediate transfer belt 11.

Referring back to FIG. 1, description about the operation of the image forming apparatus 1 will be continued.

After the liquid layer 41 is formed on the circumferential face of the intermediate transfer belt 11, ink is discharged from the four ink jet recording heads 14Y, 14M, 14C and 14K of the image forming portion 14 onto the liquid layer 41 to thereby form an image with the ink on the liquid layer 41. The liquid layer 41 with the image formed in this manner is delivered to the nip portion 15 by the rotation of the intermediate transfer belt 11.

On the other hand, a recording medium 50 for recording an image thereon is taken out from a recording media container (which is not shown) and conveyed to the nip portion 15. The recording medium 50 is conveyed while held on the circumferential face of the recording medium conveyance belt 19, so that the recording medium 50 passes through the nip portion 15 in accordance with rotation of the recording medium conveyance belt 19.

The liquid layer 41 is nipped between the conveyed recording medium 50 and the intermediate transfer belt 11 in the nip portion 15 by pressure of the pressure roll 171. On this occasion, the face of the liquid layer 41 on which the image is formed with ink by the image forming portion 14 comes into contact with the face of the recording medium 50 and the recording medium 50 is pressed from the back by the pressure roll 171, so that the liquid layer 41 and the recording medium 50 adhere to each other closely.

In the state in which the recording medium 50 is pressed from the back while the liquid layer 41 is nipped between the recording medium 50 and the intermediate transfer belt 11, the liquid layer 41 is irradiated with ultraviolet rays transmitted through the intermediate transfer belt 11 from the ultraviolet irradiation portion 16. As a result, a hardened layer 42 is formed. The face of the recording medium 50 is coated with the hardened layer 42 by the coating portion 17.

Figure 4:
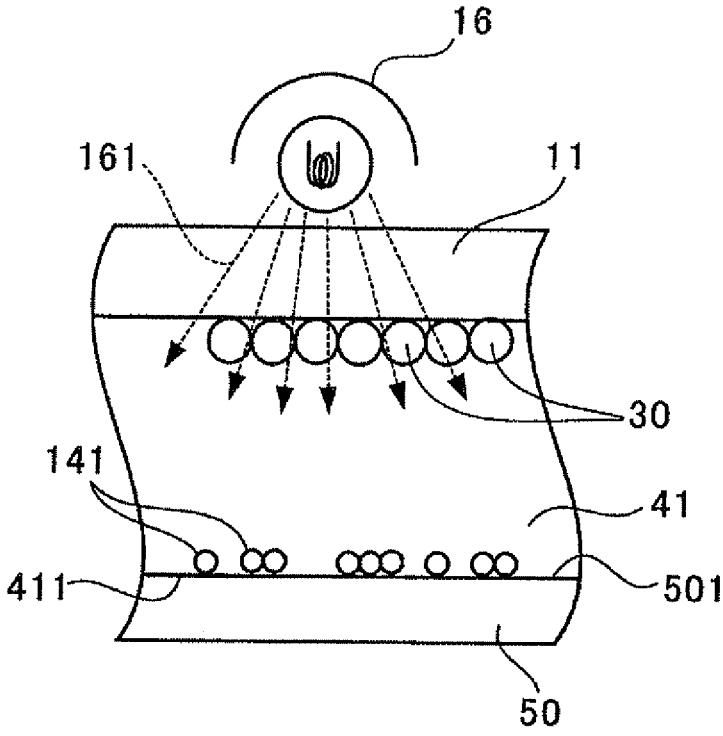
FIG. 4 is a schematic diagram showing a state in which a liquid layer is irradiated with ultraviolet rays.

FIG. 4 is a schematic diagram showing a state in which the liquid layer 41 is irradiated with ultraviolet rays.

On a contact face 411 of the liquid layer 41 being in contact with a face 501 of the recording medium 50, an image is formed with ink 141 by the image forming portion 14. Ultraviolet rays 161 irradiated from the ultraviolet irradiation portion 16 are transmitted through the intermediate transfer belt 11 and supplied to the liquid layer 41 to thereby form a hardened layer 42 (see FIG. 1). As described above, because the ultraviolet transmittance of the base portion of the intermediate transfer belt 11 is not lower than 50%, ultraviolet energy required for hardening reaction of the hardenable liquid 40 is supplied to the liquid layer 41 efficiently.

As described above, because the liquid layer 41 adheres to the recording medium 50 closely, the hardened layer 42 formed by hardening the liquid layer 41 also adheres to the recording medium 50 closely. Since the image is formed with ink 141 by the image forming portion 14 in the contact face 411 of the liquid layer 41 being in contact with the face 501 of the recording medium 50, the liquid layer 41 is nipped between the intermediate transfer belt 11 and the recording medium 50 by the nip portion 15 so that the image formed by the image forming portion 14 is recorded on the recording medium 50. In the state in which the image with ink 141 is protected by the hardened layer 42, the image of ink 141 is recorded stably on the recording medium 50. Stability of such image recording does not depend on ink 141 but depends on close adhesion between the hardened layer 42 and the recording medium 50. Accordingly, the image recording is high in the degree of freedom in selecting the recording medium 50.

After irradiation with the ultraviolet rays 161, the recording medium 50 and the hardened layer 42 pass through the nip portion 15 (see FIG. 1) in accordance with the movement of the recording medium conveyance belt 19 (see FIG. 1) and the intermediate transfer belt 11. The hardened layer 42 is separated from the intermediate transfer belt 11, so that the face of the recording medium 50 is coated with the hardened layer 42.

Figure 5:
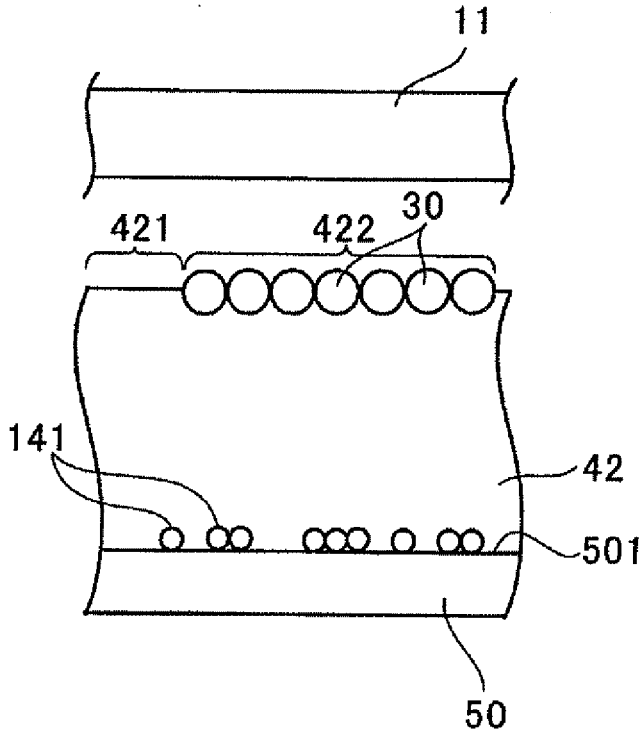
FIG. 5 is a schematic diagram showing a state in which a face of a recording medium is coated with a hardenable layer.

FIG. 5 is a schematic diagram showing a state in which the face of the recording medium 50 is coated with the hardened layer 42.

As described above, the release layer is formed in the intermediate transfer belt 11. Accordingly, at the point of time that the recording medium 50 passes through the nip portion 15, the hardened layer 42 is separated from the intermediate transfer belt 11 and transferred from the circumferential face of the intermediate transfer belt 11 onto the face 501 of the recording medium 50 as shown in FIG. 5. Solid particles 30 are present in the face of the hardened layer 42 which is transferred onto the face 501 of the recording medium 50 and with which the face 501 of the recording medium 50 is coated. More particularly, because the liquid layer 41 does not come into the gaps D (see FIG. 3) between the solid particles 30 transparent to visible light and the circumferential face of the intermediate transfer belt 11, the faces of the solid particles 30 are exposed in the face of the hardened layer 42 formed by hardening the liquid layer 41. In addition, as described above, because the liquid layer 41 comes into gaps between the solid particles 30 to some degree so that the gaps are filled with the liquid layer 41, the solid particles 30 are integrated with the hardened layer 42 formed by hardening the liquid layer 41. As described above, because the circumferential face of the intermediate transfer belt 11 is smooth, a region 421 which is in the face of the hardened layer 42 coating the recording medium 50 and in which there is no particle image drawn with the solid particles 30 is provided as a high gloss face copied from the smooth circumferential face of the intermediate transfer belt 11. On the other hand, a region 422 which is in the face of the hardened layer 42 coating the recording medium 50 and in which there is the particle image drawn with the solid particles 30 is provided as an irregular face because the solid particles 30 are exposed in the region 422. That is, irregularities are formed in the face of the recording medium 50 by the solid particles 30 so that a surface texture such as mat, emboss, etc. is provided by face irregular reflection on the irregularities. The surface texture such as mat, emboss, etc. may be provided by a difference in refractive index between the solid particles 30 and the hardened layer 42. Whether the surface texture is mat or emboss is determined based on the size of the solid particles 30, the concentration of the solid particles 30 and roughness of the irregular pattern due to the solid particles 30.

Referring back to FIG. 1, description about the operation of the image forming apparatus 1 will be continued.

The recording medium 50 with the image recorded thereon is conveyed by the recording medium conveyance belt 19 and then ejected out of the apparatus though not shown.

After the hardened layer 42 is transferred, electrostatic charges are eliminated from the circumferential face of the intermediate transfer belt 11 by the intermediate transfer belt static elimination device 18 to electrically adjust the circumferential face of the intermediate transfer belt 11.

Although the first exemplary embodiment of the image forming apparatus according to the invention has been described above, a second exemplary embodiment of the image forming apparatus according to the invention will be described.

The second exemplary embodiment which will be described below is different from the first exemplary embodiment in the particle feeding portion. In the second exemplary embodiment, a cleaning portion 28 is provided in place of the intermediate transfer belt static elimination device 18.

Elements the same as those in the first exemplary embodiment are referred to by the same numerals and signs and description thereof will be omitted. Accordingly, description will be made only on the different point from the first exemplary embodiment.

Figure 6:
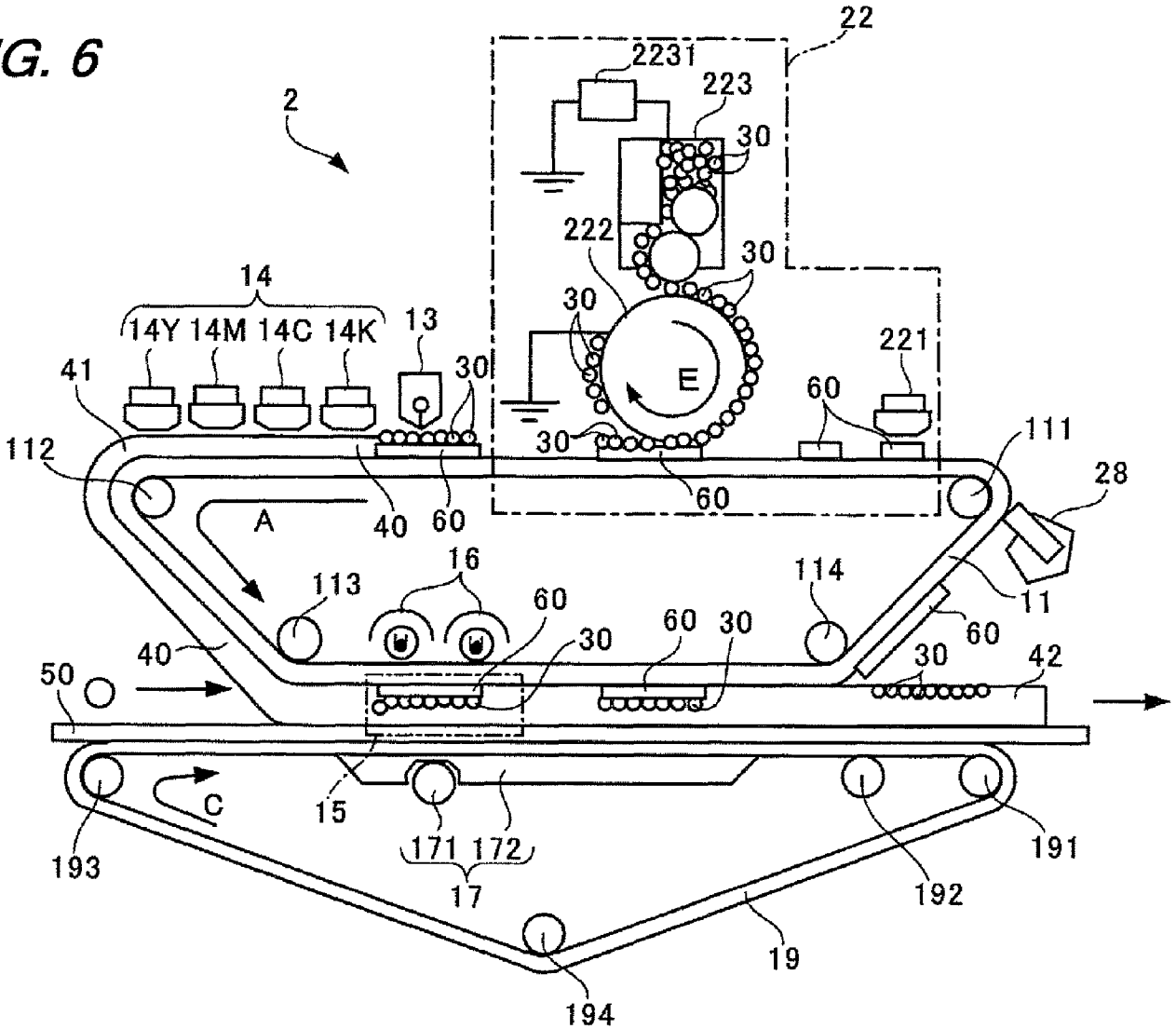
FIG. 6 is a schematic configuration diagram showing a second exemplary embodiment of the image forming apparatus according to the invention.

FIG. 6 is a schematic configuration diagram showing the second exemplary embodiment of the image forming apparatus according to the invention.

The image forming apparatus 2 shown in FIG. 6 is an ink jet recording type image forming apparatus like the image forming apparatus 1 shown in FIG. 1.

The image forming apparatus 2 includes an intermediate transfer belt 11 having a circumferential face rotating in the direction of arrow A, a particle feeding portion 22, a liquid feeding portion 13, an image forming portion 14, a nip portion 15, an ultraviolet irradiation portion 16, a coating portion 17, a cleaning portion 28, and a recording medium conveyance belt 19 having a circumferential face rotating in the direction of arrow C. The particle feeding portion 22, the liquid feeding portion 13, the image forming portion 14, the nip portion 15, the coating portion 17 and the cleaning portion 28 are disposed around the intermediate transfer belt 11 in this order in view from an upstream side in the rotating direction (the direction of arrow A) of the intermediate transfer belt 11. The ultraviolet irradiation portion 16 is disposed in a position inside the intermediate transfer belt 11 and opposite to the nip portion 15 and the coating portion 17. The recording medium conveyance belt 19 is disposed in a position outside the intermediate transfer belt 11 and opposite to the nip portion 15.

The particle feeding portion 22 feeds solid particles 30 transparent to visible light onto the circumferential face of the intermediate transfer belt 11. The particle feeding portion 22 corresponds to an example of the article feeding portion described in the invention.

The cleaning portion 28 removes an adhesive agent 60 remaining on the circumferential face of the intermediate transfer belt 11 after coating is applied by the coating portion 17.

As shown in FIG. 6, the particle feeding portion 22 includes an adhesive agent feeding portion 221, a solid particle holding portion 222, and a developing device 223.

The adhesive agent feeding portion 221 of the particle feeding portion 22 feeds the adhesive agent 60 for bonding solid particles 30 to the circumferential face of the intermediate transfer belt 11 by applying the adhesive agent 60 on the circumferential face of the intermediate transfer belt 11. A region in which the adhesive agent 60 is applied is a region of the circumferential face of the intermediate transfer belt 11 to which solid particles 30 will be fed by the particle feeding portion 22 as will be described later. That is, a region where the surface texture will be changed is controlled. The adhesive agent feeding portion 221 corresponds to an example of an adhesive agent feeding portion and an example of a region control portion described in the invention.

Specifically, for example, technology of an ink jet recording head for forming an image with ink by discharging the ink is used as the adhesive agent feeding portion 221. Specific examples of the adhesive agent 60 include polypropylene glycol (with a molecular weight of 1000 or more), poly(oxyethylene-oxypropylene) derivatives, polyoxyethylene-polyoxypropylene block polymer, silicone oil, etc.

A material which is not hardened even when the material is irradiated with ultraviolet rays and which has high ultraviolet transmittance is used as the adhesive agent 60. Adhesion of the adhesive agent 60 to the solid particles 30 is lower than adhesion of the adhesive agent 60 to the circumferential face (the outer face of the release layer) of the intermediate transfer belt 11.

The solid particle holding portion 222 of the particle feeding portion 22 has a face shaped like a cylinder. The solid particle holding portion 222 rotates in a direction of arrow E as a direction around an axis of the cylinder, so that solid particles 30 are fed to and held on the face of the solid particle holding portion 222. Specifically, for example, a low face energy film of PFA, etc. is used as a face layer of the solid particle holding portion 222. Because such a solid particle holding portion 222 has more excellent wear resistance than the photoconductor 121 used in the particle feeding portion 12 in the first exemplary embodiment, the solid particle holding portion 222 is highly reliable. The developing device 223 of the particle feeding portion 22 contains solid particles 30 and charges the solid particles 30 with static electricity by stirring the solid particles 30 in its inside. The developing device 223 feeds the solid particles 30 uniformly to electrically deposit the solid particles 30 on the whole face of the solid particle holding portion 222. Because there is no image formed on the face of the solid particle holding portion 222, the developing device 223 in the second exemplary embodiment does not perform so-called development either. However, the developing device 223 is also referred to as "developing device" because the developing device 223 has the same configuration as that of a developing device in the electrophotographic technology which has been heretofore known in the background art. When the solid particles 30 thus electrically deposited on the face of the solid particle holding portion 222 reach the circumferential face of the intermediate transfer belt 11, the solid particles 30 are deposited on the adhesive agent 60 in the region where the adhesive agent 60 is fed to the circumferential face of the intermediate transfer belt 11. That is, the solid particles 30 are fed from the face of the solid particle holding portion 222 to the circumferential face of the intermediate transfer belt 11 in the region where the adhesive agent 60 is applied. Solid particles 30 which are not deposited on the adhesive agent 60 are continuously held on the face of the solid particle holding portion 222 and return to the developing device 223 in accordance with the rotation of the solid particle holding portion 222. The solid particles 30 are mixed with new solid particles 30 as the new solid particles 30 are deposited by the developing device 223. A combination of the solid particle holding portion 222 and the developing device 223 corresponds to an example of a particle deposition portion described in the invention. Similarly to the developing device 124 in the first exemplary embodiment, the developing device 223 has a developing bias voltage control portion 2231 which controls a developing bias voltage of the developing device 223. The developing bias voltage control portion 2231 adjusts the supply concentration of the solid particles 30 fed by the solid particle feeding portion 22 to thereby adjust the intensity of irregularities corresponding to the surface texture of the recording medium 50. The developing bias voltage control portion 2231 corresponds to an example of a concentration adjustment portion described in the invention.

The particle feeding portion 22 including the adhesive agent feeding portion 221, the solid particle holding portion 222 and the developing device 223 as shown in FIG. 6 is simpler in structure and higher in durability than the particle feeding portion 12 including the photoconductor 121, the charging device 122, the exposure device 123, the developing device 124, the transfer device 125 and the photoconductor static elimination device 126 as shown in FIG. 1.

A combination of the intermediate transfer belt 11, the particle feeding portion 22, the liquid feeding portion 13, the ultraviolet irradiation portion 16 and the nip portion 15 in the aforementioned image forming apparatus 2 corresponds to an exemplary embodiment of a coating apparatus according to the invention.

Operation of the image forming apparatus 2 shown in FIG. 6 will be described below.

The intermediate transfer belt 11 is supported by belt support rolls 111, 112, 113 and 114 and has a circumferential face rotating in the direction of arrow A.

The adhesive agent 60 is fed and applied to the circumferential face of the intermediate transfer belt 11 by the adhesive agent feeding portion 221 so that solid particles 30 are deposited on the circumferential face of the intermediate transfer belt 11 by the adhesive agent 60 this manner, a region of the circumferential face of the intermediate transfer belt 11 to which solid particles 30 will be fed is determined. That is, a region where the surface texture will be changed is controlled so that the surface texture of the recording medium is changed in accordance with each region. The adhesive agent 60 fed to the circumferential face of the intermediate transfer belt 11 is conveyed in the direction of arrow A in accordance with the rotation of the intermediate transfer belt 11.

On the other hand, the solid particles 30 transparent to visible light and charged with static electricity by the developing device 223 are uniformly fed and electrically deposited on the whole face of the solid particle holding portion 222 driven to rotate in the direction of arrow E. On this occasion, as described above, the developing bias voltage of the developing device 223 is controlled by the developing bias voltage control portion 2231 to adjust the supply concentration of the solid particles 30 to thereby adjust the intensity of irregularities corresponding to the surface texture of the recording medium 50.

Then, the solid particles 30 electrically deposited on the face of the solid particle holding portion 222 are deposited on the adhesive agent 60 fed to the circumferential face of the intermediate transfer belt 11. That is, the solid particles 30 are fed from the face of the solid particle holding portion 222 to the circumferential face of the intermediate transfer belt 11 in the region where the adhesive agent 60 is applied. In the state in which the solid particles 30 fed to the circumferential face of the intermediate transfer belt 11 are deposited on the adhesive agent 60, the solid particles 30 are conveyed in the direction of arrow A in accordance with the rotation of the intermediate transfer belt 11.

Then, the liquid feeding portion 13 feeds a hardenable liquid 40, in a form of a layer, onto the circumferential face of the intermediate transfer belt 11 by which the solid particles 30 are conveyed as described above, so that a liquid layer 41 is formed. The hardenable liquid 40 is fed, in a form of a layer, onto the circumferential face of the intermediate transfer belt 11 on which the solid particles 30 are fed, so that the hardenable liquid 40 is superposed on the solid particles 30. In this manner, a liquid layer 41 is formed. On this occasion, the hardenable liquid 40 in the liquid layer 41 comes into gaps between the solid particles 30 to some degree so that the gaps between the solid particles 30 are filled with the hardenable liquid 40. However, the hardenable liquid 40 does not come into gaps between the solid particles 30 and the circumferential face of the intermediate transfer belt 11 because the adhesive agent 60 is present in the gaps between the solid particles 30 and the circumferential face of the intermediate transfer belt 11.

After the liquid layer 41 is formed on the circumferential face of the intermediate transfer belt 11, an image is formed with ink on the liquid layer 41 by the image forming portion 14 in the same manner as the operation of the image forming portion 14 in the first exemplary embodiment. The liquid layer 41 with the image formed thus is delivered to the nip portion 15 by the rotation of the intermediate transfer belt 11.

On the other hand, a recording medium 50 for recording an image thereon is taken out from the recording medium container (which is not shown) and conveyed to the nip portion 15. The recording medium 50 is conveyed while held on the circumferential face of the recording medium conveyance belt 19 and passes through the nip portion 15 in accordance with the rotation of the recording medium conveyance belt 19.

The liquid layer 41 is nipped together with the adhesive agent 60 between the conveyed recording medium 50 and the intermediate transfer belt 11 in the nip portion 15 by pressure of the pressure roll 171. On this occasion, the face of the liquid layer 41 on which an image is formed with ink by the image forming portion 14 comes into contact with the face of the recording medium 50, so that the recording medium 50 is pressed from the back by the pressure roll 171. In this manner, the liquid layer 41 and the recording medium 50 adhere to each other closely.

In the state in which the recording medium 50 is pressed from the back while the liquid layer 41 is nipped together with the adhesive agent 60 between the recording medium 50 and the intermediate transfer belt 11, the liquid layer 41 is irradiated with ultraviolet rays transmitted through the intermediate transfer belt 11 and the adhesive agent 60 from the ultraviolet irradiation portion 16. As a result, a hardened layer 42 is formed. The face of the recording medium 50 is coated with the hardened layer 42 by the coating portion 17. As described above, the adhesive agent 60 is not hardened even when the adhesive agent 60 is irradiated with ultraviolet rays.

As described above, because the liquid layer 41 adheres closely to the recording medium 50, the hardened layer 42 formed by hardening the liquid layer 41 also adheres closely to the recording medium 50. Since an image is formed with ink on a contact face of the liquid layer 41 being in contact with the face of the recording medium 50 by the image forming portion 14, the liquid layer 41 is nipped between the intermediate transfer belt 11 and the recording medium 50 by the nip portion 15, so that the image formed by the image forming portion 14 is consequently recorded on the recording medium 50. The image formed with ink is recorded stably on the recording medium 50 while the image is protected by the hardened layer 42.

After irradiation with ultraviolet rays 161, the recording medium 50, the adhesive agent 60 and the hardened layer 42 pass through the nip portion 15 in accordance with the movement of the recording medium conveyance belt 19 and the intermediate transfer belt 11. The hardened layer 42 is separated from the intermediate transfer belt 11 so that the face of the recording medium 50 is coated with the hardened layer 42.

As described above, because the release layer is formed in the intermediate transfer belt 11, the hardened layer 42 is separated from the intermediate transfer belt 11 and transferred from the circumferential face of the intermediate transfer belt 11 onto the face of the recording medium 50 at the point of time that the recording medium 50 passes through the nip portion 15. As described above, because the adhesion of the adhesive agent 60 to the solid particles 30 is lower than the adhesion of the adhesive agent 60 to the circumferential face (the outer face of the release layer) of the intermediate transfer belt 11, the adhesive agent 60 is released from the solid particles 30 and continuously held on the circumferential face of the intermediate transfer belt 11 so as to be conveyed toward the cleaning portion 28 in accordance with the rotation of the solid particle holding portion 222. Accordingly, the faces of the solid particles 30 are exposed in the face of the hardened layer 42 which is transferred onto the face of the recording medium 50 so that the face of the recording medium 50 is coated with the hardened layer 42. As described above, the circumferential face of the intermediate transfer belt 11 is so smooth that the surface texture is gloss in the region where the solid particles 30 are not deposited (that is, the region where the adhesive agent 60 is not applied). On the other hand, the surface texture is mat or emboss in the region where the solid particles 30 are deposited (that is, the region where the adhesive agent 60 is applied).

The recording medium 50 with the image recorded thereon is conveyed by the recording medium conveyance belt 19 and then ejected to the outside (which is not shown) of the apparatus.

After coating performed by the coating portion 17, the adhesive agent 60 remaining on the circumferential face of the intermediate transfer belt 11 is removed by the cleaning portion 28. As a result, it is possible to avoid deposition of the adhesive agent 60 in an unnecessary region.

Although each of the aforementioned exemplary embodiments has been described in the case where the movable body described in the invention is the intermediate transfer belt, the movable body described in the invention is not limited thereto. For example, any movable body such as a roll may be used as long as the circumferential face of the movable body may rotate.

Although each of the aforementioned exemplary embodiments has been described in the case where the hardenable liquid described in the invention is a liquid hardened by irradiation with ultraviolet rays, the hardenable liquid described in the invention is not limited thereto. For example, the hardenable liquid may be a liquid hardened by an electron beam or heat applied on the liquid.

Although each of the aforementioned exemplary embodiments has been described in the case where the image recording portion described in the invention forms an image with ink by discharging the ink onto the hardenable liquid fed, in a form of a layer, by the liquid feeding portion and the liquid layer is nipped between the intermediate transfer belt and the recording medium by the nip portion so that the image is consequently recorded on the recording medium, the image recording portion described in the invention is not limited thereto. For example, the image may be recorded on the recording medium by an electrophotographic method as long as the image may be recorded on the recording medium. Incidentally, in this case, the image is recorded in advance on the recording medium by the electrophotographic method so that the face of the recording medium on which the image is recorded is coated with the hardened layer.

The foregoing description of the exemplary embodiment of the present invention has been provided for the purpose of illustration and description. It is not intended to be exhaustive or to limit the invention to the precise forms disclosed. Obviously, many modifications and various will be apparent to practitioners skilled in the art. The embodiments were chosen and described in order to best explain the principles of the invention and its practical application, thereby enabling other skilled in the art to understand the invention for various embodiments and with the various modifications as are suited to the particular use contemplated. It is intended that the scope of the invention be defined by the following claims and their equivalents.

DESCRIPTION OF REFERENCE NUMERALS AND SIGNS

1,2 image forming apparatus
11 intermediate transfer belt
111, 112, 113, 114 belt support roll
12, 22 particle feeding portion
121 photoconductor
122 charging device
123 exposure device
124, 223 developing device
1241, 2231 developing bias voltage control portion
125 transfer portion
126 photoconductor static elimination device
221 adhesive agent feeding portion
222 solid particle holding portion
13 liquid feeding portion
14 image forming portion
141 ink
15 nip portion

16 ultraviolet irradiation portion
161 ultraviolet rays
17 coating portion
171 pressure roll
172 support body
18 intermediate transfer belt static elimination device
19 recording medium conveyance belt
191, 192, 193, 194 belt support roll
28 cleaning portion
30 solid particle
40 hardenable liquid
41 liquid layer
411 contact face
42 hardened layer
421, 422 region
50 recording medium
501 face
60 adhesive agent

What is claimed is:

1. A coating apparatus comprising:

a movable body that includes a circumferential face capable of rotating;

a particle feeding portion that feeds solid particles transparent to visible light to the circumferential face of the movable body;

a liquid feeding portion that feeds a hardenable liquid, in a form of a layer, onto the solid particles at the circumferential face of the movable body so that the hardenable liquid overlaps the solid particles, the hardenable liquid being hardened by a stimulus given to the hardenable liquid;

a stimulus giving portion that gives the stimulus to the hardenable liquid fed on the circumferential face;

a nip portion that nips the hardenable liquid between the movable body and a recording medium; and a concentration adjusting portion that adjusts a supply concentration of the solid particles to be fed by the particle feeding portion.

2. The coating apparatus according to claim 1, further comprising a region control portion that controls a region of the circumferential face to which the solid particles is fed by the particle feeding portion.

3. The coating apparatus according to claim 1, wherein the particle feeding portion includes:

an image holding portion that holds an image formed on a face of the image holding portion;

an electrostatic image forming portion that forms an electrostatic image on the face of the image holding portion;

a particle image forming portion that forms a particle image drawn with the solid particles by charging the solid particles with static electricity to electrically deposit the solid particles on the electrostatic image formed by the electrostatic image forming portion; and a transfer portion that transfers the particle image from the face of the image holding portion onto the circumferential face of the movable body.

4. The coating apparatus according to claim 1, wherein the particle feeding portion includes:

an adhesive agent feeding portion that feeds an adhesive agent to the circumferential face of the movable body for bonding the solid particles to the circumferential face of the movable body; and a particle deposition portion that deposits the solid particles on the adhesive agent fed to the circumferential face of the movable body.

5. An image forming apparatus comprising:

a movable body having a circumferential face capable of rotating;

a particle feeding portion that feeds solid particles transparent to visible light to the circumferential face of the movable body;

a liquid feeding portion that feeds a hardenable liquid, in a form of a layer, onto the solid particles at the circumferential face of the movable body so that the hardenable liquid overlaps the solid particles, the hardenable liquid being hardened by a stimulus given to the hardenable liquid;

a stimulus giving portion that gives the stimulus to the hardenable liquid fed on the circumferential face;

a nip portion that nips the hardenable liquid between the movable body and a recording medium;

an image recording portion that records an image on the recording medium; and a concentration adjusting portion that adjusts a supply concentration of the solid particles to be fed by the particle feeding portion.

6. The image forming apparatus according to claim 5, wherein the image recording portion records an image on the recording medium in such a manner that the image is formed on the hardenable liquid fed, in a form of a layer, by the liquid feeding portion and is nipped between the movable body and the recording medium by the nip portion.

7. The image forming apparatus according to claim 6, wherein the hardenable liquid is hardened by irradiation with ultraviolet rays.

8. The image forming apparatus according to claim 5, wherein the particle feeding portion includes:

an adhesive agent feeding portion that feeds an adhesive agent to the circumferential face of the movable body for bonding the solid particles to the circumferential face of the movable body; and a particle deposition portion that deposits the solid particles on the adhesive agent fed to the circumferential face of the movable body.

9. The image forming apparatus according to claim 5, further comprising a region control portion that controls a region of the circumferential face to which the solid particles is fed by the particle feeding portion.

10. A coating apparatus comprising:

a movable body that includes a circumferential face capable of rotating;

a particle feeding portion that feeds solid particles transparent to visible light to the circumferential face of the movable body, wherein the particle feeding portion comprises:

an adhesive agent feeding portion that feeds an adhesive agent to the circumferential face of the movable body for bonding the solid particles to the circumferential face of the movable body; and a particle deposition portion that deposits the solid particles on the adhesive agent fed to the circumferential face of the movable body;

a liquid feeding portion that feeds a hardenable liquid, in a form of a layer, on the circumferential face of the movable body supplied with the solid particles, the hardenable liquid being hardened by a stimulus given to the hardenable liquid;

a stimulus giving portion that gives the stimulus to the hardenable liquid fed on the circumferential face;

a nip portion that nips the hardenable liquid between the movable body and a recording medium; and a concentration adjusting portion that adjusts a supply concentration of the solid particles to be fed by the particle feeding portion.

* * * * *